United States Patent [19]

Akachi et al.

[11] Patent Number: 4,617,543

[45] Date of Patent: Oct. 14, 1986

[54] COIL BOBBIN

[75] Inventors: Yoshiaki Akachi; Yasuo Kyoso; Takeo Matsumaru, all of Chiba, Japan

[73] Assignee: TDK Corporation, Tokyo, Japan

[21] Appl. No.: 694,427

[22] Filed: Jan. 24, 1985

[30] Foreign Application Priority Data

| | | | |
|---|---|---|---|
| Jan. 26, 1984 | [JP] | Japan | 59-10025[U] |
| Jan. 26, 1984 | [JP] | Japan | 59-10026[U] |
| Feb. 28, 1984 | [JP] | Japan | 59-28614[U] |

[51] Int. Cl.[4] ..... H01F 15/10; H01F 27/30

[52] U.S. Cl. ..... 336/192; 336/198

[58] Field of Search ..... 336/198, 208, 192; 310/194

[56] References Cited

U.S. PATENT DOCUMENTS

| | | | |
|---|---|---|---|
| 4,257,027 | 3/1981 | Yasuhisa | 336/208 X |

FOREIGN PATENT DOCUMENTS

| | | | |
|---|---|---|---|
| 97599 | 1/1984 | European Pat. Off. | 336/198 |
| 2311612 | 3/1973 | Fed. Rep. of Germany | 336/208 |
| 2422236 | 12/1979 | France | 336/208 |
| 76634 | 6/1977 | Japan | 336/198 |
| 1250827 | 10/1971 | United Kingdom | 336/198 |

*Primary Examiner*—Thomas J. Kozma

*Attorney, Agent, or Firm*—Wyatt, Gerber, Shoup, Scobey & Badie

[57] ABSTRACT

An improved structure of a coil bobbin for a transformer in a switching power supply circuit. The coil bobbin comprises an outer bobbin (30) having a first hollow cylindrical member (12) having a first flange (13) located around one end thereof, said first flange having a first terminal plate (15) with a plurality of a first terminal pins (16) and a first grooves (26) for accommodating lead wires, the first member (12) having a second flange (31) located around the other end thereof, and an inner bobbin (2) having a second hollow cylindrical member (21) having a third flange (22) located around one end thereof, the third flange having a second terminal plate (23) with a plurality of a second terminal pins (24) and a second grooves (25) for accommodating lead wires. The coil bobbin in assembled by inserting the second hollow member (21) into the first hollow member (12) so that the first and second terminal plates are parallel with each other in the horizontal direction. The second flange (31) has further a cover portion (18) whose outside face butts with the inside face of the second terminal plate and covers opening ends of the second grooves on the inside face. The presence of the cover portion (18) provides a long creeping insulation distance between a lead wire of the coil wound on the second member (21) and the coil wound on the first member (12) sufficient for satisfying the safety standards issued in each country.

1 Claim, 11 Drawing Figures

COIL BOBBIN

BACKGROUND OF THE INVENTION

The present invention relates to the structure of a coil bobbin and, in particular, relates to a dual coil bobbin consisting of two overlapped coil bobbins, or an outer coil bobbin and an inner coil bobbin. The present coil bobbin is utilized for a transformer in a switching power supply circuit.

A conventional dual coil bobbin is shown in FIGS. 1 through 3. FIG. 1 is a disassembled perspective view of the conventional dual coil bobbin, FIG. 2 is a cross sectional view of a transformer assembly utilizing the coil bobbin of FIG. 1, and FIG. 3 is a cross sectional view along the line $A_1$—$A_1$ of FIG. 2. In those figures, the dual coil bobbin is assembled by an outer bobbin 1 and an inner bobbin 2, both of which are made of dielectric material such as synthetic resin. The outer bobbin 1 and the inner bobbin 2 have a cylindrical hollow members 12 and 21, respectively. The radius of the member 12 is greater than that of the member 21.

The cylindrical member 12 of the outer bobbin 1 has two flanges 13 and 14 mounted around both the ends thereof. The flange 13 has a terminal plate 15 having a plurality of terminal pins 16 for the connection of lead wires 42 of a coil 3 fitted on the cylindrical member 12 to an external circuit (not shown). The terminal plate 15 has also a plurality of grooves 26 which are formed on its top surface. Those grooves 26 accommodate the lead wires 42 extended from the coil 3 to the terminal pins 16. The cylindrical member 21 of the inner bobbin 2 has a flange 22 mounted around one end thereof. The flange 22 has terminal plates 23 with a plurality of terminal pins 24 and grooves 25 which are the same configuration as those of the outer bobbin 1. The terminal pins 24 is to connect lead wires 41 of a coil 4 fitted on the cylindrical member 21 to an external circuit. The grooves 25 accommodate the lead wires 41 extended from the coil 4 to the terminal pins 24.

When the transformer is assembled by the outer bobbin 1 with the coil 3 and the inner bobbin 2 with the coil 4, the cylindrical member 21 of the inner bobbin 2 is inserted into the axial bore 11 of the cylindrical member 12 of the outer bobbin 1 so that the termianl plates 15 and 23 are located in parallel with each other in the horizontal direction, as shown in FIG. 2. Of course, the transformer assembly has a cylindrical core 5 made of magnetic material inserted into the axial bore of the cylindrical member 21. The transformer utilizing the dual coil bobbin of FIG. 1 is mounted on a printed circuit board (not shown) by using terminal pins 25 and 26. In this case, the coil 3 of the outer bobbin 1 is used as a secondary winding applied with a low voltage and the coil 4 of the inner bobbin 2 is used as a primary winding applied with a high voltage.

In this case, it should be noted that the coil bobbin utilized for a power transformer must satisfy the lawful safety standards issued in each country. It is known that a creeping insulation distance is the most important factor regulated by safety standards. The creeping distance stands for the shortest distance between adjacent conductors measured along the surface of a solid dielectric material interposed therebetween. If the creeping distance between adjacent conductors interposed by solid dielectric material is short, insulation between those conductors would not be established sufficiently. Therefore, the spark discharge would sometimes arise between them. Therefore, the creeping distance sufficient for establishing insulation is regulated by the safety standards in view of safety in each country.

In the above mentioned dual coil bobbin, the grooves 25 are provided in order to elongate the creeping distance between two adjacent lead wires 41—41 accommodated therein to make sure of insulation therebetween. The presence of the grooves 25 of the inner bobbin 2 is very effective because the lead wires 41 accommodated in the grooves 25 handle the high voltage. The grooves 26 of the outer bobbin 1 have the same function as the grooves 25.

On the other hand, insulation between the coil 3 and the lead wires 41 of the coil 4 must be established as well. The creeping distance between those conductors must extend about 6 millimeters according to the safety standard issued in each country. The creeping distance between the coil 3 and the lead wires 41 is defined by the flange 14. In this case, the creeping distance between the coil 3 and the lead wire 41-1 passing through the groove 25-1 located in the middle of the terminal plate 23 differs from that between the coil 3 and the lead wire 41-2 passing through the groove 25-2 located in the extreme end of the plate 23. First, as shown in FIG. 2 the opening end of the groove 25-1 on the inside face of the plate 23 is substantially covered by the flange 14. Therefore, the creeping distance between the coil 3 and the lead wire 41-1 accommodated in the groove 25-1 is relatively long, so that insulation between those conductors is assured to some extent. On the other hand, as shown in FIG. 3, the opening end of the groove 25-2 on the inside face of the plate 23 is not covered by the flange 14 at all. This means the creeping distance between the coil 3 and the lead wire 41-2 accommodated in the groove 25-2 is very short. Therefore, it is impossible to establish the creeping distance of 6 millimeters regulated by the safety standards.

In order to overcome this disadvantage, and elongate the creeping distance between the coil 3 and lead wires 41 accommodated in the grooves 25, as shown in FIG. 4, insulating tapes 6 and 7 are provided around both the ends of the cylindrical member 12, or as shown in FIG. 5 the coil 3 is partially wrapped by an insulating tape 8. However, the presence of the insulating tapes 6 and 7 causes the cross sectional area to reduce to deteriorate performance of the transformer. On the other hand, use of the insulating tape 8 causes the assembly operation to be complicated and prevents application of automatic assembly operation.

SUMMARY OF THE INVENTION

It is an object, therefore, of the present invention to overcome the disadvantage of a prior coil bobbin by an improved coil bobbin.

It is also an object of the present invention to provide a coil bobbin in which the creeping distance between a coil of an outer bobbin and lead wires extended from a coil of an inner bobbin is sufficiently long to establish insulation between those conductors.

The above and other objects are attained by a coil bobbin comprising an outer bobbin having a first hollow member having a first flange located around one end thereof, said first flange having a first terminal plate with a plurality of a first terminal pins and a first grooves for accommodating lead wires, said first member having a second flange located around the other end thereof, and an inner bobbin having a second hollow member having a third flange located around one end thereof, said third flange having a second terminal plate with a plurality of a second terminal pins and a second grooves for accommodating lead wires, said coil bobbin assembled by inserting said second hollow member into said first hollow member so that said first and second terminal plates are parallel with each other in the horizontal direction, characterized in that said second flange has a cover portion whose outside face butts with the inside face of said second terminal plate and covers opening ends of said second grooves on said inside face.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1:
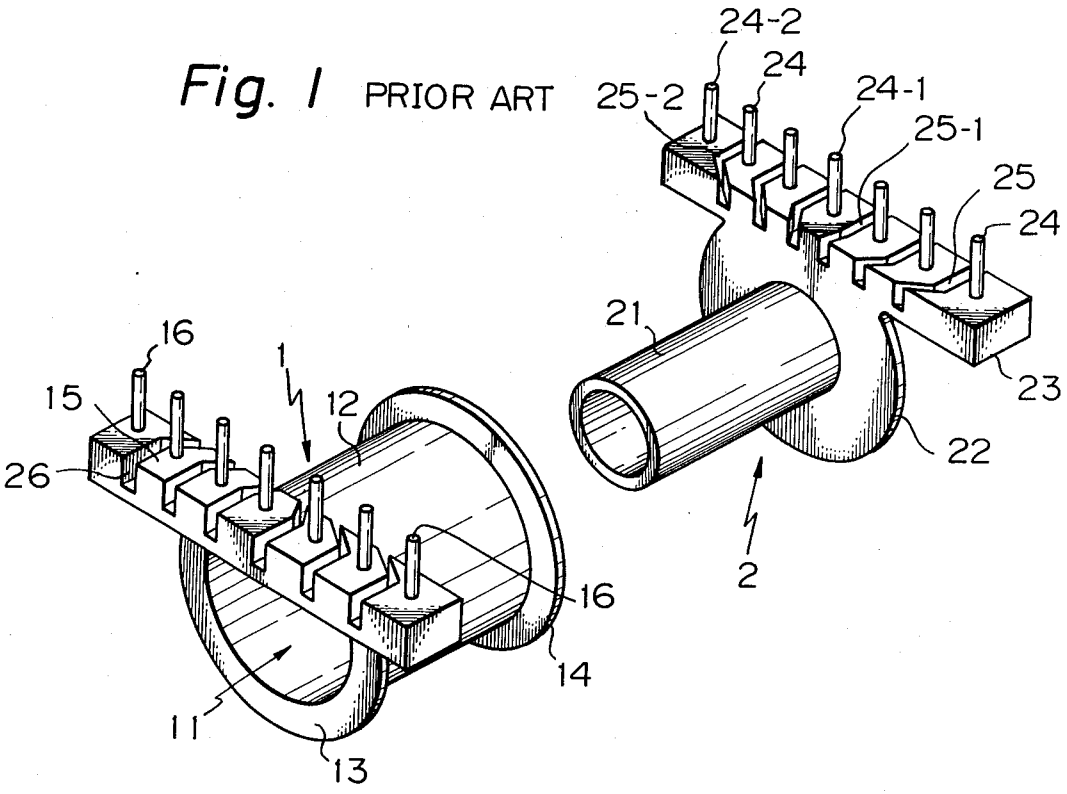
Fig. 1 PRIOR ART
FIG. 1 is a disassembled perspective view of a conventional dual coil bobbin.
Figure 2:
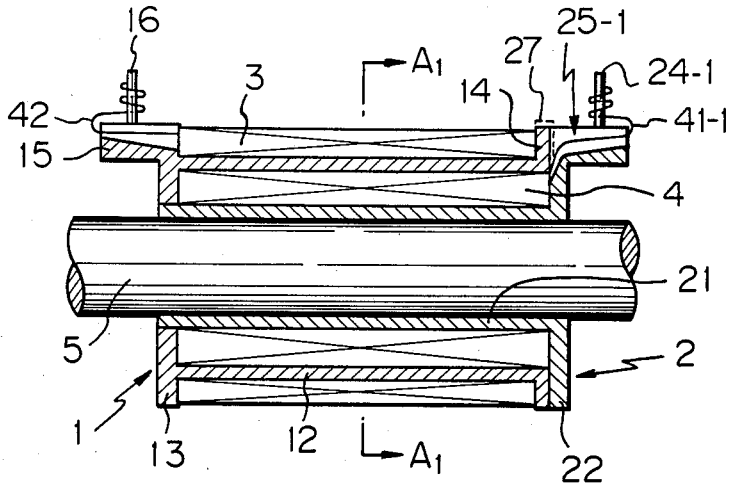
Fig. 2 PRIOR ART
FIG. 2 is a cross sectional view of a transformer utilizing the coil bobbin of FIG. 1.
Figure 3:
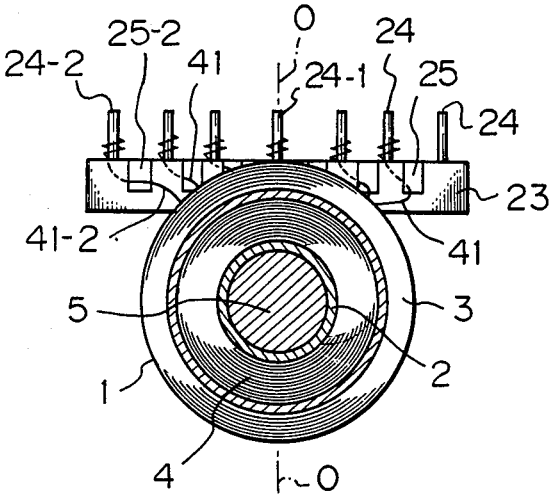
Fig. 3 PRIOR ART
FIG. 3 is a cross sectional view along the line $A_1$—$A_1$.
Figure 4:
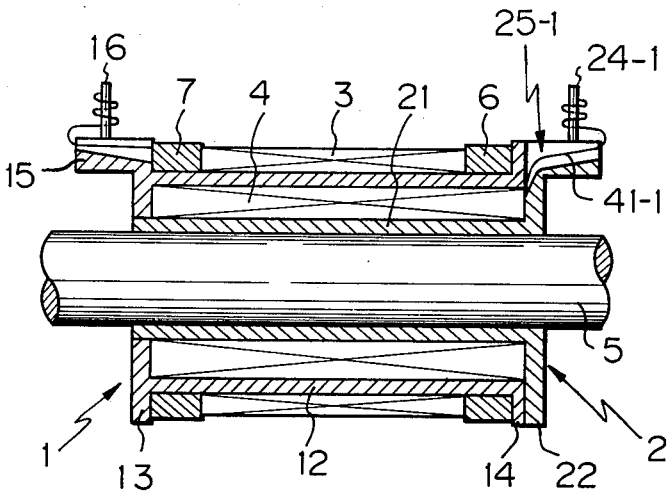
Fig. 4 PRIOR ART
FIG. 4 is a cross sectional view of another conventional coil bobbin.
Figure 5:
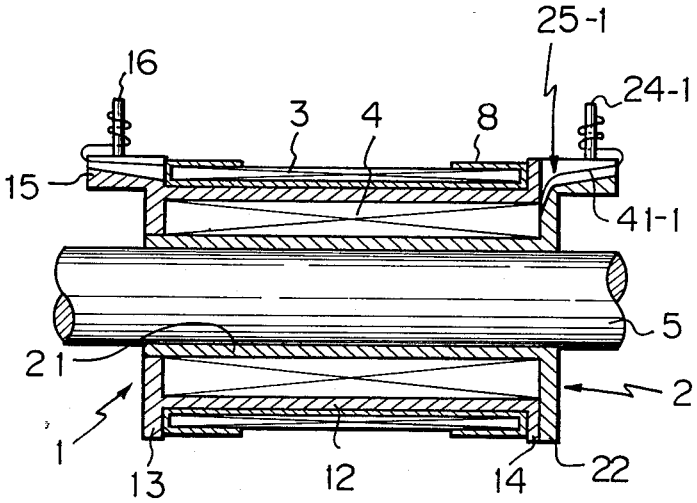
Fig. 5 PRIOR ART
FIG. 5 is a cross sectional view of still another conventional coil bobbin.
Figure 6:
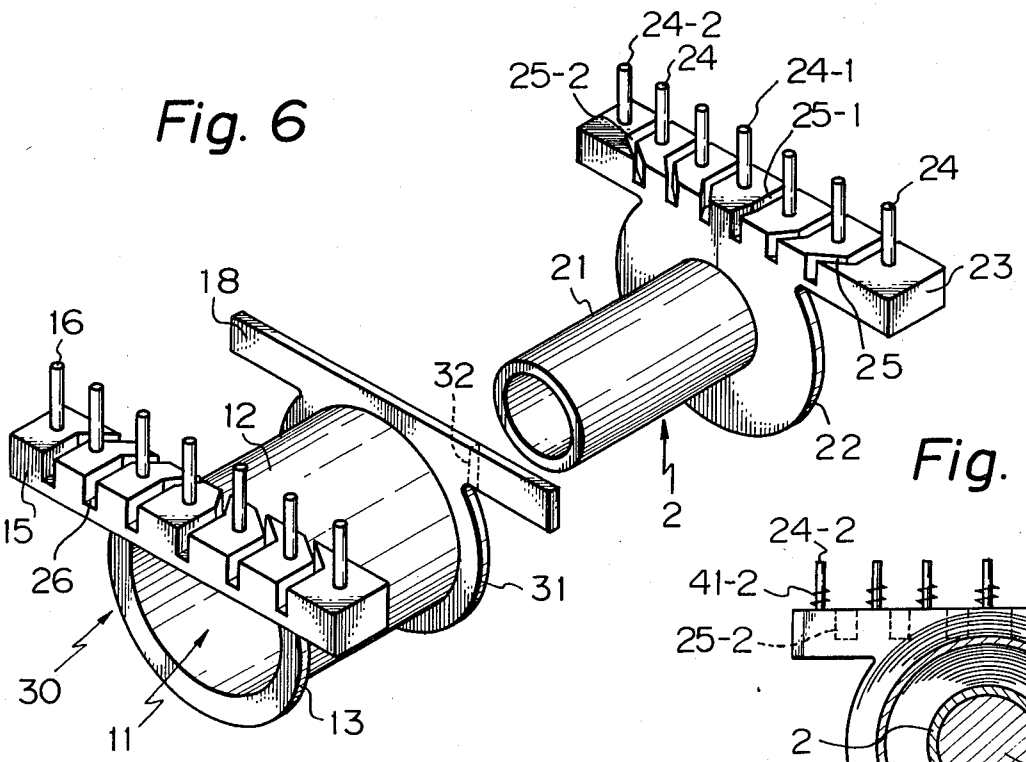
FIG. 6 is a perspective view of a disassembled dual coil bobbin incorporating principles of the present invention.
Figure 7:
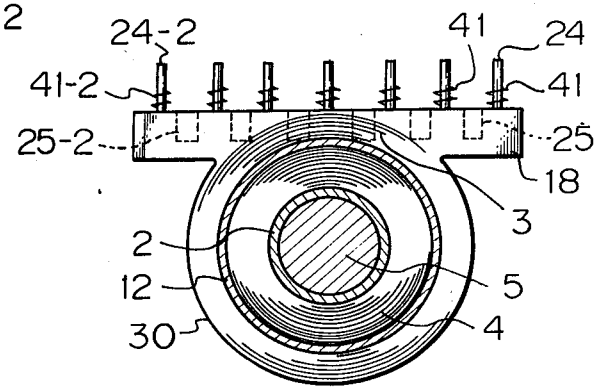
FIG. 7 is a cross sectional view of a transformer utilizing the coil bobbin of FIG. 6.

The present invention is best understood by preference to FIGS. 6 and 7. In those figures, identical reference numerals are used to denote identical elements in FIGS. 1 through 3. As apparent from those figures, the inner coil bobbin 2 has the same configuration as that of the prior coil bobbin mentioned hereinbefore. That is, the inner coil bobbin 2 is composed of the cylindrical hollow number 21 on which the primary coil 4 is fitted and the flange 22 around one end of the member 21, the flange 22 having the terminal plate 23 with a plurality of terminal pins 24 extending outwardly in the direction perpendicular to the axial direction as well as a plurality of grooves 25 on the top surface of the terminal plate 23. On the other hand, an outer bobbin 30 comprises the cylindrical hollow member 12 on which the secondary coil 3 is fitted and the flange 13 having a plurality of terminal pins 16 and grooves 26. Those components of the outer bobbin 30 are identical with the respective components of the outer bobbin 1 shown in FIG. 1.

A feature of the present invention is the presence of a cover portion 18 which is a part of a flange 31 around the one end of the member 12 opposite to the end around which the flange 13 is mounted. The cover portion 18 is so designed that when the coil bobbin is assembled, its outside face butts with the corresponding inside face of the terminal plate 23 to cover all the opening ends of the grooves 25 on the inside face of the plate 23. Thus, for example, the cover portion 18 is formed so that it is slender and its outside face fits the inside face of the terminal plate 23 in size. The cover portion 18 acts as a barrier between the primary coil 3 of the outer bobbin 30 and the lead wires 41 extended from the secondary coil 4. Therefore, it will be apparent that the creeping distance between the primary coil 3 of the outer bobbin 30 and the lead wires 41 extended from the coil 4 is longer than that of the prior coil bobbin of FIG. 1. One example of this creeping distance is denoted by the dotted line 32. In particular, it will be appreciated that the creeping distance between the coil 3 and the lead wire 41-2 accommodated in the groove 25-2 located at the extreme end of the plate 23 is much longer than that of the bobbin of FIG. 1. As a result, according to the present coil bobbin, it is easy to obtain the creeping distance of about 6 millimeters requested by the safety standard without using the insulating tapes. It should be noted that use of the insulating tapes deteriorates performance of the transformer and also prevents easy assembly operation as mentioned hereinbefore. In addition to those advantages, when the cover portion 18 projects upwardly from the top face of the terminal plate 23 more or less, the present coil bobbin has the advantage that the cover portion 18 acts as a stand member upon mounting the coil assembly with coils on a printed circuit board by using pins 16 and 24.

The preferred embodiment of the present invention is shown in FIGS. 8A through 8D. In those figures, a dual coil bobbin is assembled by an inner bobbin 50 and an outer bobbin 60. The inner bobbin 50 has a cylindrical hollow member 56 on which a primary coil (not shown) is fitted and a flange 53 mounted around one end thereof. The flange 53 has a terminal plate 51 with a plurality of terminal pins 52 and grooves 55. On the other hand, the outer bobbin 60 has a cylindrical hollow member 66 on which a secondary coil (not shown) is fitted, a flange 63 mounted around one end thereof, and a flange 69 mounted around the other end thereof having a cover portion 70 corresponding to the cover portion 18 shown in FIG. 6. The flange 63 has a terminal plate 62 with a plurality of terminal pins 62 and grooves 65.

On the outside face of the terminal plate 51 there are mounted a plurality of projections 57. Those projections 57 are located along the side edges of the grooves 55 on the outside face of the plate 51, this edge extending parallel to the terminal pins 52. A lead wire (not shown) extended from the primary coil on the member 56 through the corresponding groove 55 passes through a space between two opposite projections 57—57 to be connected to the corresponding terminal pin 52. The presence of the projections 57 makes it possible to elongate the creeping distance between adjacent lead wires on the outside face of the terminal plate 51. Likewise, there is a plurality of projections 67 mounted on the outside face of the terminal plate 61.

Figure 8A:
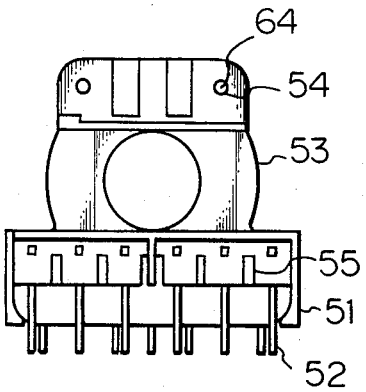
FIG. 8A is a front view of an assembled dual coil bobbin according to a preferred embodiment of the present invention.
Figure 8B:
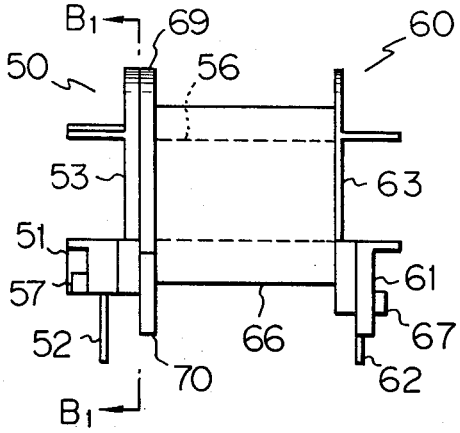
FIG. 8B is a side view of the preferred embodiment.
Figure 8C:
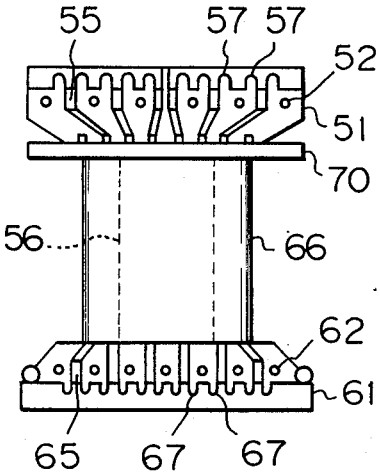
FIG. 8C is a bottom view of the preferred embodiment.
Figure 8D:
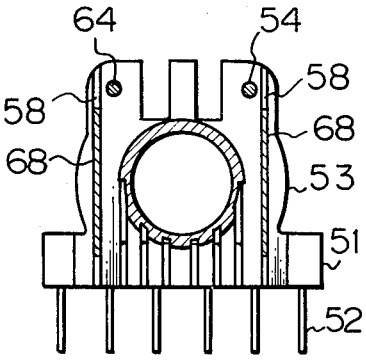
FIG. 8D is a cross sectional view along the line $B_1$—$B_1$ of FIG. 8B.

The inside face of the flange 53 has two grooves 58 parallel with each other in the direction perpendicular to the axial direction as shown in FIG. 8D. That inside face has also two through holes 54 in the circular shape. On the other hand, the outside face of the flange 69 butting with the inside face of the flange 53 has two projections whose cross sectional areas are denoted by the reference numeral 68 in FIG. 8D. Those projections 68 engage with the corresponding grooves 58 in assembly. The outside face of the flange has also two cylindrical projections 64 engaging with the corresponding through holes 54. Because of the presence of those members 54, 58, 64 and 68, positioning of the inner core 50 and the outer core 60 is facilitated.

It will be apparent that some modification is possible to those skilled in that art, for instance, dual rectangular hollow members on which coils are fitted, are possible, instead of cylindrical hollow members.

Further, the present invention can apply to a coil bobbin of a vertical type, which is mounted on the printed circuit board so that its axial direction is perpendicular to the surface of the board.

From the foregoing, it will now be apparent that a new and improved coil bobbin has been found. It should be understood of course that the embodiments disclosed are merely illustrative and are not intended to limit the scope of the invention. Reference should be made to the appended claim, therefore, rather than the specification as indicating the scope of the invention.

What is claimed is:

1. A coil bobbin comprising an outer bobbin having a first hollow member having a first flange located around one end thereof, said first flange having a first terminal plate with a plurality of first terminal pins and first grooves for accommodating lead wires, said first member having a second flange located around the other end thereof, and an inner bobbin having a second hollow member having a third flange located around one end thereof, said third flange having a second terminal plate with a plurality of second terminal pins and second grooves for accommodating lead wires, said coil bobbin beng assembled by inserting said second hollow member into said first hollow member so that said first and second terminal plates are parallel with each other characterized in that said second flange has a cover portion having an outside face that butts with an inside face of said second terminal plate and covers opening ends of said second grooves on said inside face, said cover portion extending beyond said second terminal plate, the bottom surface of said cover portion being flat and forming a continuous bottom surface so that said bottom surface butts uniformly on a surface of a printed circuit board when the assembled coil bobbin is mounted on said printed circuit board, wherein said cover portion elongates the creeping distance between a coil on said outer bobbin and said lead wires extended from a coil on said inner bobbin to said second terminal pins and said cover supports said assembled coil bobbin.

* * * * *